US011116323B2

(12) United States Patent
Wang et al.

(10) Patent No.: US 11,116,323 B2
(45) Date of Patent: Sep. 14, 2021

(54) FOLDING COT

(71) Applicant: Ningbo Matrix Trading Co., Ltd., Ningbo (CN)

(72) Inventors: Wenjie Wang, Ningbo (CN); Zhengming He, Ningbo (CN); Libo Song, Ningbo (CN)

( * ) Notice: Subject to any disclaimer, the term of this patent is extended or adjusted under 35 U.S.C. 154(b) by 0 days.

(21) Appl. No.: 16/843,857

(22) Filed: Apr. 8, 2020

(65) Prior Publication Data

US 2020/0315361 A1 Oct. 8, 2020

Related U.S. Application Data

(60) Provisional application No. 62/831,066, filed on Apr. 8, 2019.

(30) Foreign Application Priority Data

Jan. 16, 2020 (CN) ..... 201920843406.4

(51) Int. Cl.

| | |
|---|---|
| ***A47C 19/14*** | (2006.01) |
| ***A47C 17/72*** | (2006.01) |
| ***A47C 17/70*** | (2006.01) |
| ***A47C 17/66*** | (2006.01) |
| ***A47C 19/12*** | (2006.01) |
| ***A47B 9/02*** | (2006.01) |

(Continued)

(52) U.S. Cl.

CPC ..... *A47C 19/14* (2013.01); *A45F 4/06* (2013.01); *A47B 9/02* (2013.01); *A47C 17/64* (2013.01); *A47C 17/66* (2013.01); *A47C 17/70* (2013.01); *A47C 17/72* (2013.01); *A47C 19/12* (2013.01); *A47B 2003/045* (2013.01); *A47C 17/76* (2013.01)

(58) Field of Classification Search

CPC ..... A47C 17/64; A47C 19/12; A47C 19/14; A47C 17/76; A47C 17/72; A47C 17/645; A47C 19/126; A47C 17/66; A47C 17/68; A47C 17/70; A47C 17/74; A47C 17/78; A47B 2003/045; A47B 9/02; A47B 3/10; A45F 4/06

See application file for complete search history.

(56) References Cited

U.S. PATENT DOCUMENTS 2,860,351 A * 11/1958 La Russa ..... A61G 7/00 5/178
8,499,380 B2 * 8/2013 Grace ..... A47C 17/64 5/110

(Continued)

FOREIGN PATENT DOCUMENTS

DE 4002483 A1 * 8/1991 ..... A61N 5/0614

*Primary Examiner* — David R Hare
*Assistant Examiner* — Madison Emanski
(74) *Attorney, Agent, or Firm* — WPAT Law, P.C.; Anthony King

(57) ABSTRACT

This folding cot has a frame including a first rail member and a second rail member, a sheet material coupled to the frame and extending between the first and second rail members thereof, and a plurality of foldable leg assemblies where each leg assembly being pivotally connected to the first and second rail members, and wherein each leg assembly further includes a first leg pivotally coupled to a second leg. There is a tension spring having a first end attached to the first leg and a second end attached to the second leg.

15 Claims, 13 Drawing Sheets

(51) Int. Cl.

| | |
|---|---|
| ***A45F 4/06*** | (2006.01) |
| ***A47C 17/64*** | (2006.01) |
| ***A47B 3/04*** | (2006.01) |
| *A47C 17/76* | (2006.01) |

(56) References Cited

U.S. PATENT DOCUMENTS

| | | | | |
|---|---|---|---|---|
| 2010/0235987 | A1* | 9/2010 | So | A47C 17/72 5/112 |
| 2015/0282629 | A1* | 10/2015 | Lamke | A47C 17/72 5/111 |

* cited by examiner

FOLDING COT

CROSS-REFERENCE TO RELATED APPLICATIONS

This application claims priority to U.S. Provisional Patent Application No. 62/831,066, filed on Apr. 8, 2019, and claims priority to China Patent Application No. 201920843406.4, filed on Jan. 16, 2020, now pending, both of which are hereby incorporated by reference in their entireties.

FIELD OF THE DISCLOSURE

The present disclosure relates to a piece of collapsible furniture, and more particularly, to a collapsible folding cot.

BACKGROUND OF THE DISCLOSURE

Folding cots are known to have a pair of rail with a fabric stretched between the pair of rails. Folding cots are also known to have straps extending from the four corners of the fabric for detachable attachment to the rails. These straps are useful in making the fabric taut with minimal slack when in an unfolded position.

Due to the way known folding cots are designed, a user must manually attach and detach these straps from the rails during folding and unfolding.

There is a continuing need for new structural designs that eliminate the need to manually attach and detach these straps during folding and unfolding.

Also, there is a need for a simple and easy system to lock a folding cot in an unfolded position.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned needs. Although the present embodiments may obviate one or more of the above-mentioned needs, it should be understood that some aspects of the embodiments might not necessarily obviate them.

BRIEF SUMMARY OF THE DISCLOSURE

In a general implementation, a folding cot includes a first rail member and a second rail member. There is a sheet material coupled to and extend between the first and second rail members. The folding cot can have a plurality of foldable leg assemblies wherein each leg assembly being pivotally connected to the first and second rail members. Each leg assembly can also have a first leg and a second leg, where the first leg is pivotally coupled to the second leg.

In one aspect combinable with the general implementation, there can be a single-piece cross member having a first end attached to the first leg and a second end attached to the second leg.

In another aspect combinable with the general implementation, there is no pivoting joint within the single-piece cross member, and the single-piece cross member can be self-biased against bending. When a force is applied towards the cross member in a cross-wise direction, the cross member has a resiliency to return to a straight configuration.

There can be an optional cylindrical sleeve enveloping the tension spring.

In another aspect combinable with the general implementation, the cross member can be a spring, more specifically, a tension spring.

In another aspect combinable with the general implementation, a leg of the leg assembly is pivotally coupled to a rail member at a pivot point.

In another aspect combinable with the general implementation, at each corner of the sheet member there can be a tether that extends toward the rail members. The tethers can be fastened to the rail members either at a pivot point where a leg is joined with the rail member, or at a location on the rail member approximate such pivot point.

There are various embodiments of how these tethers are disposed relative to the rail member. In one embodiment, these tethers are permanently fixed onto the rail member. In another embodiment, these tethers do not extend across a bottom side of the first rail member when the folding cot is unfolded.

In yet another embodiment, these tethers extend across either an upper side or a terminal side of the corresponding rail members when the folding cot is unfolded.

In still another embodiment, the tethers remain fastened to their corresponding rail members and are not readily detachable from them when the folding cot is folded up.

While this specification contains many specific implementation details, these should not be construed as limitations on the scope of any inventions or of what may be claimed, but rather as descriptions of features specific to particular implementations of particular inventions.

Certain features that are described in this specification in the context of separate implementations can also be implemented in combination in a single implementation. Conversely, various features that are described in the context of a single implementation can also be implemented in multiple implementations separately or in any suitable subcombination.

Also, although features may be described above and below as acting in certain combinations and even initially claimed as such, one or more features from a claimed combination can in some cases be excised from the combination, and the claimed combination may be directed to a subcombination or variation of a subcombination.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

Figure 1:
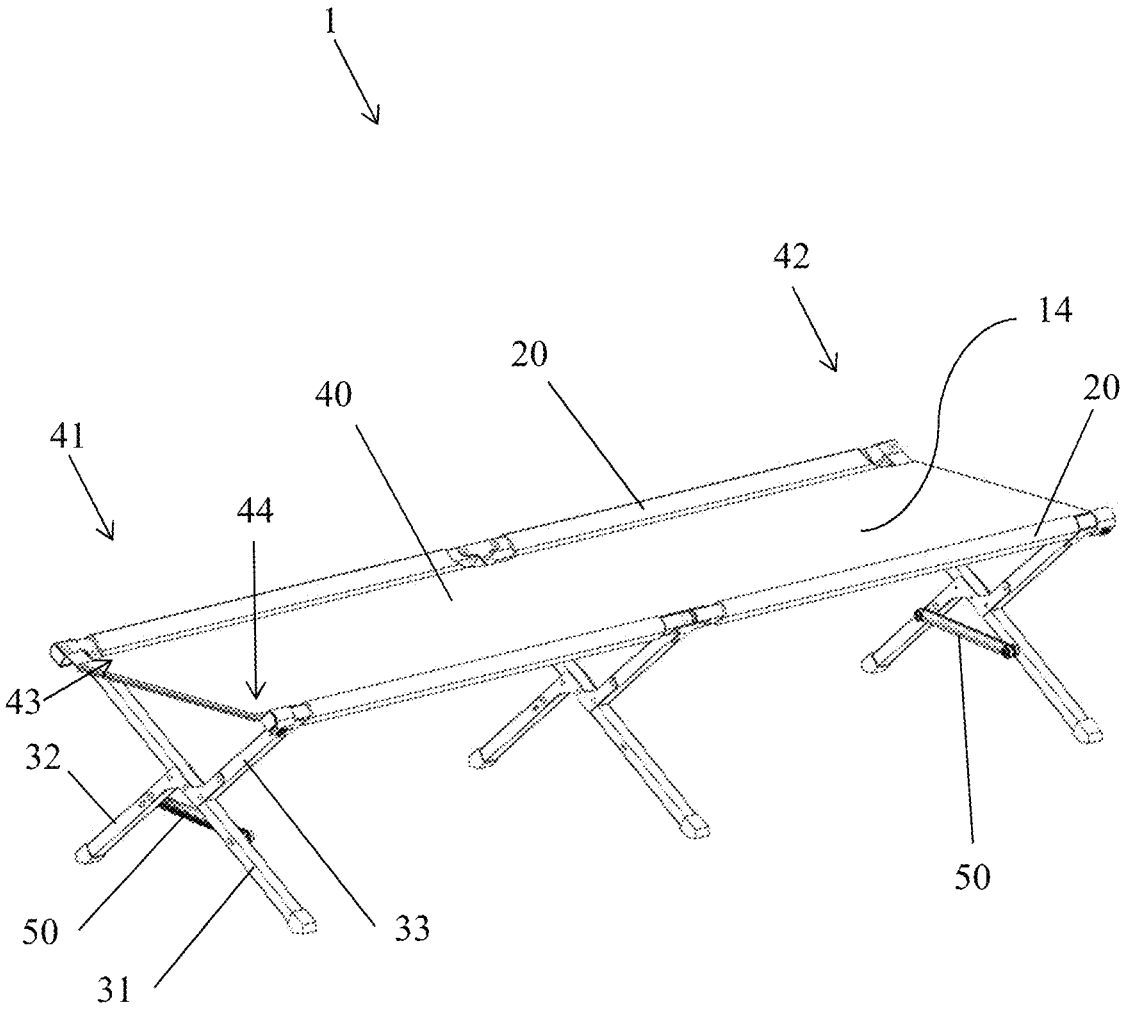
FIG. 1 is a perspective view of an embodiment of a folding cot according to an aspect of the disclosure.

The following call-out list of elements in the drawing can be a useful guide when referencing the elements of the drawing figures:

1 Folding cot
10 Frame
20 Rail member
21 Underside of the rail member
22 Upper side of the rail member
23 Outer side of the rail member
24 Interior side of the rail member
25 Terminal side of the rail member
26 Pivot point
27 Elbow bracket
30 Leg assembly
31 First leg
32 Second leg
33 Support arm
40 Sheet material
41 Head end
42 Foot end
44 Corner region of the sheet material
45 Tether
50 Cross member
62 Sleeve cover
70 Fastener

DETAILED DESCRIPTION OF THE EMBODIMENTS

The different aspects of the various embodiments can now be better understood by turning to the following detailed description of the embodiments, which are presented as illustrated examples of the disclosure as defined in the claims. It is expressly understood that the embodiments as defined by the claims may be broader than the illustrated embodiments described below.

As used herein, the term "bend" or "bent" in conjunction with the cross member refers to an action to deform a linear position into a non-linear position, such as a curved shape. It does not mean pivoting in the sense that it does not require an elbow joint or pivoting joint.

The inventors have discovered a novel method of folding and unfolding a cot without having to manually attached and detach the corner tethers are that are typical in known cots.

Referring now to FIG. 1, the contemplated folding cot 1 has a similar frame and folding mechanism as typical folding cots, such as that disclosed in U.S. Pat. No. 8,499,380, which is herein incorporated by reference in its entirety. Comparing to the frame and folding mechanism of U.S. Pat. No. 8,499,380, the presently contemplated folding cot has similar frame 10, rail member 20, leg assembly 30 (as better shown in FIGS. 2-4), and sheet material 40.

In one aspect of an embodiment, a cross member 50 can be provided and attached to a first leg 31 and a second leg 32. While FIG. 1 shows a cross member 50 disposed at the head end 41 of the folding cot 1 and another disposed at the foot end 42 of the folding cot 1, in some embodiments there can be a third cross member 50 disposed on the middle leg assembly 30 which is in the middle of the folding cot 1. Also contemplated is a design where only one such cross member 50 is provided in the entire folding cot 1.

Figure 2:
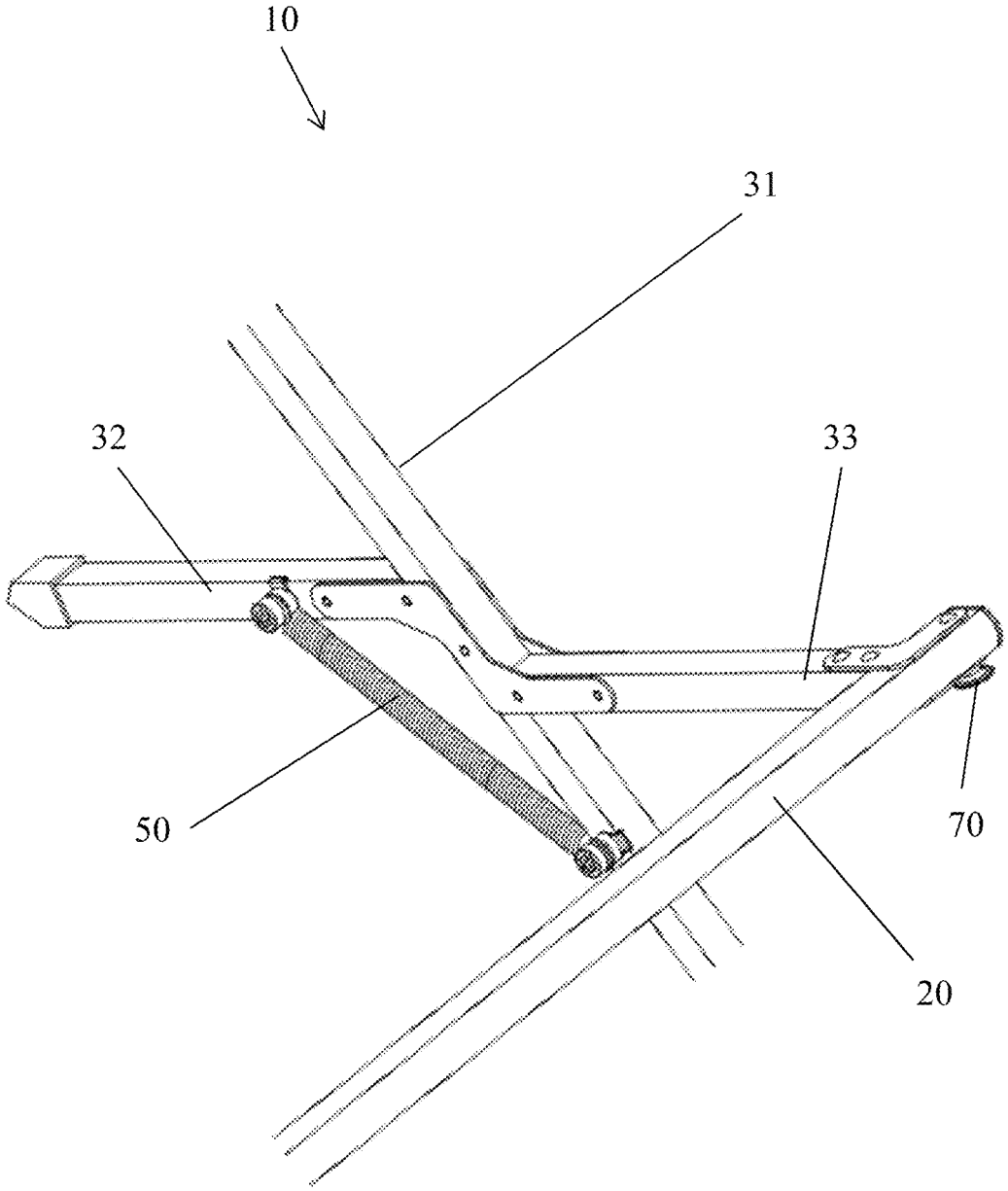
FIG. 2 is a close-up view of the foot end of the folding cot of FIG. 1, where the sheet material is not shown in order to show the detail of the frame.
Figure 3:
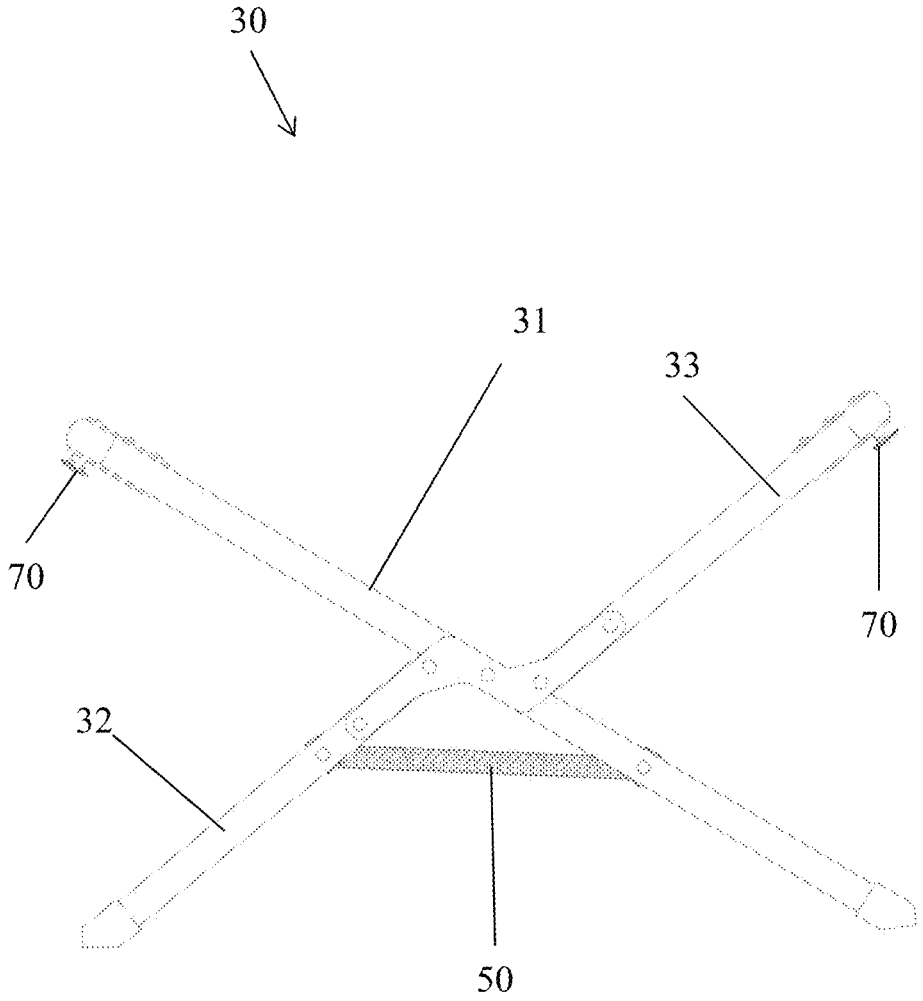
FIG. 3 is a front view of the leg assembly according to an aspect of the disclosure.
Figure 4:
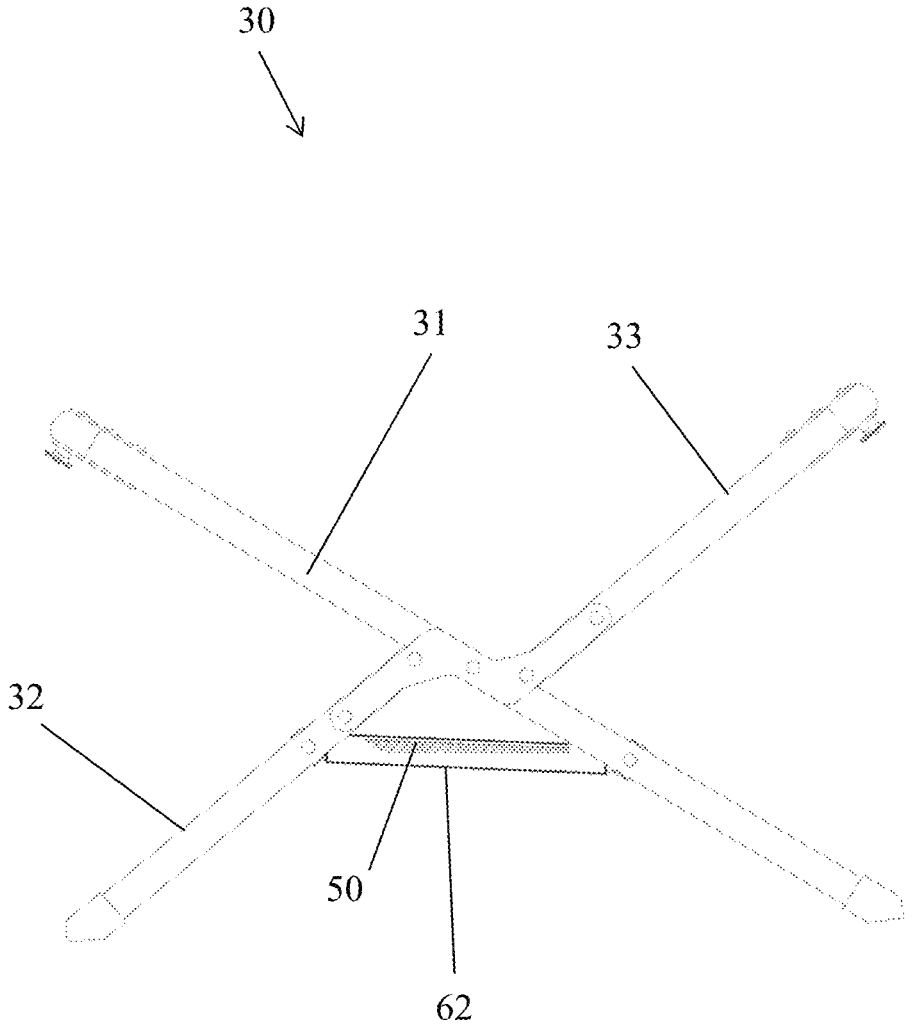
FIG. 4 is a front view of one embodiment of the leg assembly with a sleeve enclosing the cross member, according to an aspect of the disclosure.

Referring now to FIGS. 2 and 3, both of which illustrate the foot end of the frame 10 of FIG. 1 with the sheet material 40 removed for ease of illustration. Here, cross member 50 can have one terminal end fixed to the first leg 31 of the leg assembly 30, and can have another terminal end fixed to the second leg 32 of the leg assembly. In the embodiment shown here, the terminal ends of the cross member 50 are not detachably fixed to the first and second legs 31, 32. In other words, the cross member 50 cannot be easily removed or detached from the leg assembly 30 without using a tool. In another way, the cross member 50 cannot be readily detached from the leg assembly 30. Alternatively, the cross member 50 can be designed such that it is detachably attached to the leg assembly 30 and can be readily detached by a user.

In one embodiment, the cross member 50 has a single-piece body such that the cross member 50 itself has no moving parts that is movable relative to other parts of the cross member 50. In yet another embodiment, the cross member 50 itself is an integral one piece design and has not detachable parts or assembled parts within itself.

In another embodiment, the cross member 50 has not pivoting joint or elbow joint within itself.

In a further embodiment, the cross member 50 is self-biased against bending out of its original shape (i.e., shape at rest) when a force is applied towards the cross member 50 in a cross-wise direction. In other words, when a force is applied in a direction perpendicular to the longitudinal axis of the cross member 50, the natural tendency of the cross member 50 is to resist such force.

In yet another embodiment, the contemplated cross member 50 may or may not have a resilient or self-biasing tendency, or may have a relatively slight resilient or self-biasing tendency to remain straight, the cross member 50 can have a physical property that prevents lengthwise compression. That is, such physical property cannot allow shortening of the cross member 50 when force is applied on both terminal ends of the cross member towards each other. In one contemplated example, the cross member 50 can be a linear coil spring, more specifically a tension spring such as that shown in FIG. 2. At rest and while being assembled to the first and second legs 31, 32 (and in a unfolded configuration), this embodiment provides that there are no spaces between each coil. In other words, the pitch of the tension spring is zero. This embodiment of the cross member 50 therefore provides a physical property where a user may not shorten the cross member 50. Put it in another way, the distance of the two terminal points of attachment to the first leg 31 and second leg 32 cannot be shortened without bending the cross member 50.

What's keeping the cross member 50 in FIG. 2 from bending can be a self-biasing force as described above or below. In some embodiments, alternatively or optionally, it can be a mere result of tightly packed coils. Because the two legs 31, 32 are not able to spread further apart from each other in the unfolded position shown in FIG. 2, the zero pitch tightly-packed coils remain tightly packed, preventing the tension spring from sagging due to gravity.

In still another embodiment, the cross member 50 has an internal design or physical property giving itself a straight or linear configuration while at rest. When such cross member 50 is yet to be assembled to the first leg and second leg 31, 32, the cross member 50 can have such property standing alone at rest.

Contemplated cross member 50 can be made of suitable materials to provide a resilient or springing physical property to biases itself into a straight or linear position. Such materials include natural and synthetic polymers, various metals and metal alloys, naturally occurring materials, textile fibers, and all reasonable combinations thereof.

Contemplated cross member 50 can have suitable structural designs to provide a resilient or springing physical property to biases itself into a straight or linear position. Such designs include the coil spring and tension spring described above and a compression spring.

The cross member 50 can be optionally covered or enveloped by a sleeve 62. The sleeve can protect the cross member from the elements and can minimize damage to the cross member. Contemplated designs of such sleeve 62 can include a plastic cover, a fabric cover, a rubber cylinder, or another other flexible covering. One contemplated purpose of the optional sleeve 62 can be to assist the cross member 50 in staying in a straight configuration.

Sleeve 62 can cover over a substantial length of the cross member 50.

Figure 5:
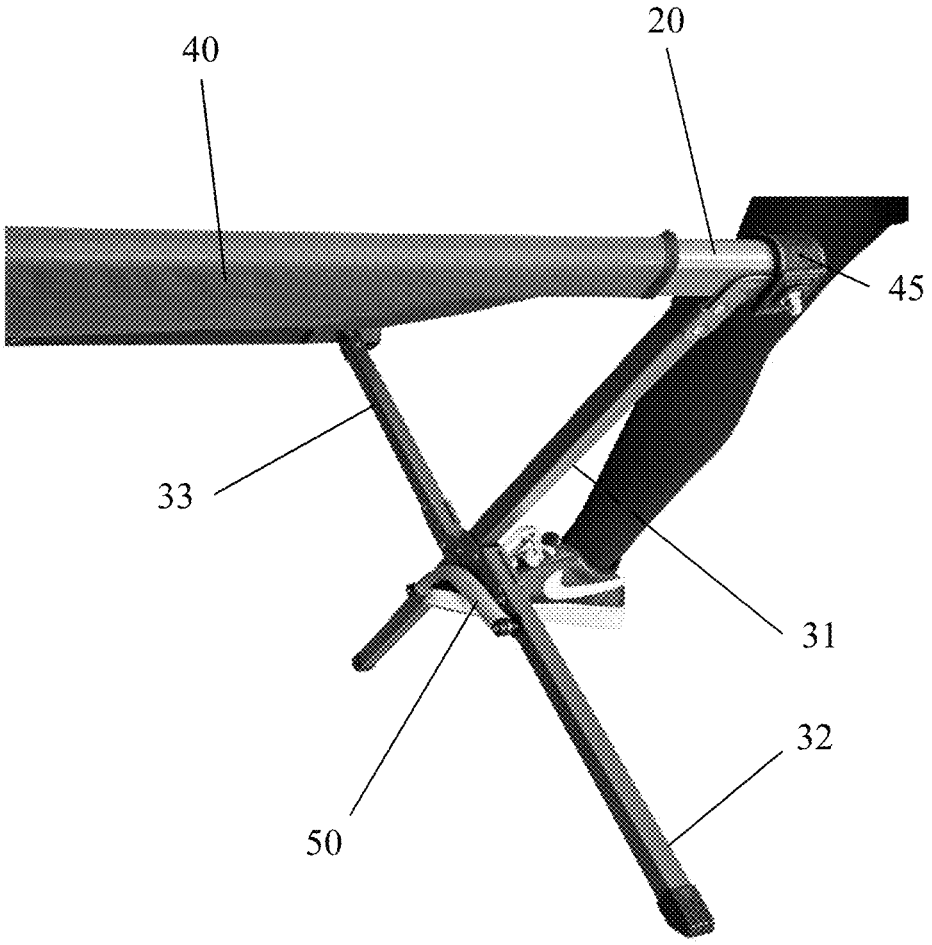
FIG. 5 is a view of the foot end of the folding cot of FIG. 1, illustrating a user deforming the cross member, according to an aspect of the disclosure.

In operation, to fold the leg assembly 30 a user can use a slight upward or downward force cross-wise to the cross member 50, such as that illustrated in FIG. 5. In FIG. 5, a user uses the back of his or her foot to bend the cross member 50. Once bent, the cross member 50 no longer prevents the distance between the two points of attachment to first leg 31 and second leg 32 from shortening. The user may next manually fold the first leg 31 towards the second leg 32.

Contemplated cross member 50 can be used to provide an "auto-lock" function to prevent the leg assembly 30 from accidental folding. In typical folding cot, a user would need to remember to manually "lock" a pivoting cross member when the cot is in a fully unfolded position. Without locking the leg assembly in place, a folding cot can easily collapse and its leg assembly folded up when someone accidentally tips the cot over sideways. Here, the contemplated "auto-luck" function provides a user a peace of mind without having to remember to lock the cross member. Also, the contemplated cross member eliminates accidental finger-pinching that often happens with known folding cots.

Figure 6:
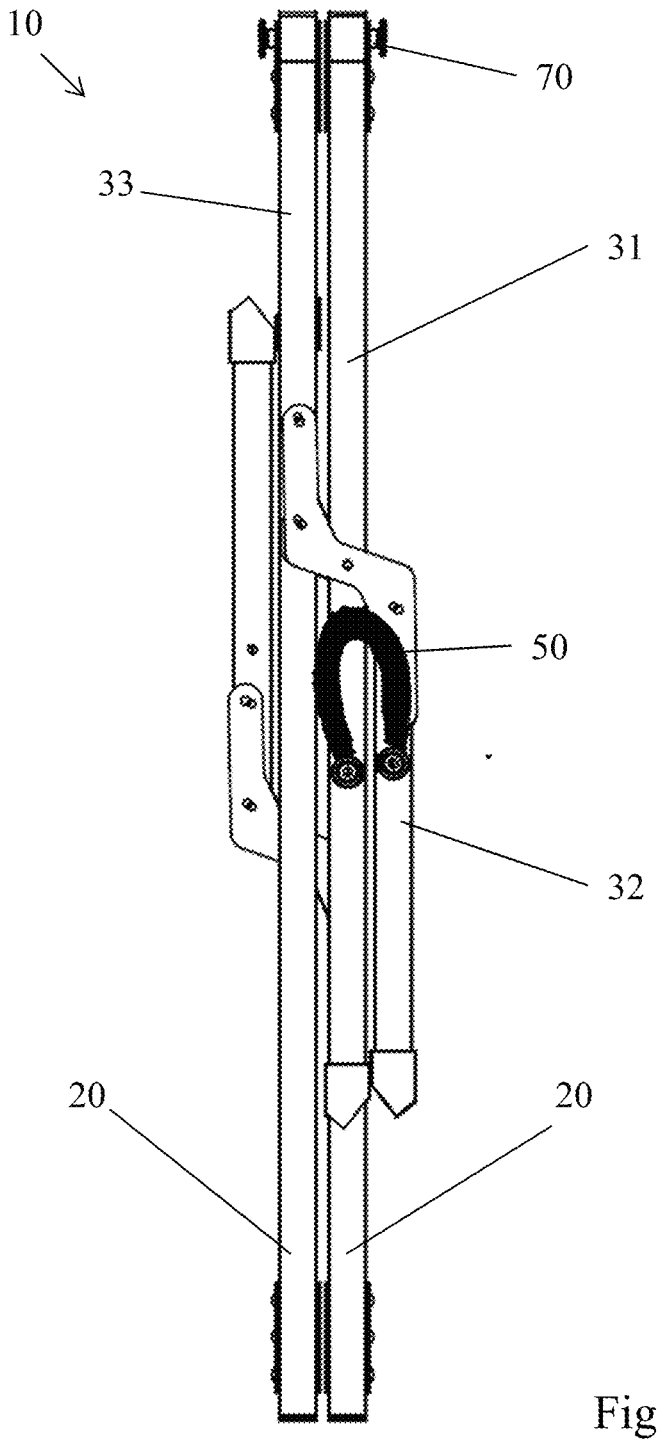
FIG. 6 is a front of a folded frame without the sheet material for ease of illustration, according to an aspect of the disclosure.

FIG. 6 illustrates a shape of the cross member 50 when the leg assembly 30 is in a fully folded position. Here, both terminal ends of the cross member 50 remain attached to the first leg 31 and second leg 32. In designs where a tension spring is used, the pitch or spacing between each coil would be greater now, especially where the bending angle is the greatest. In FIG. 6, the sheet material 40 is not shown to best illustrate the frame 10.

Figure 7:
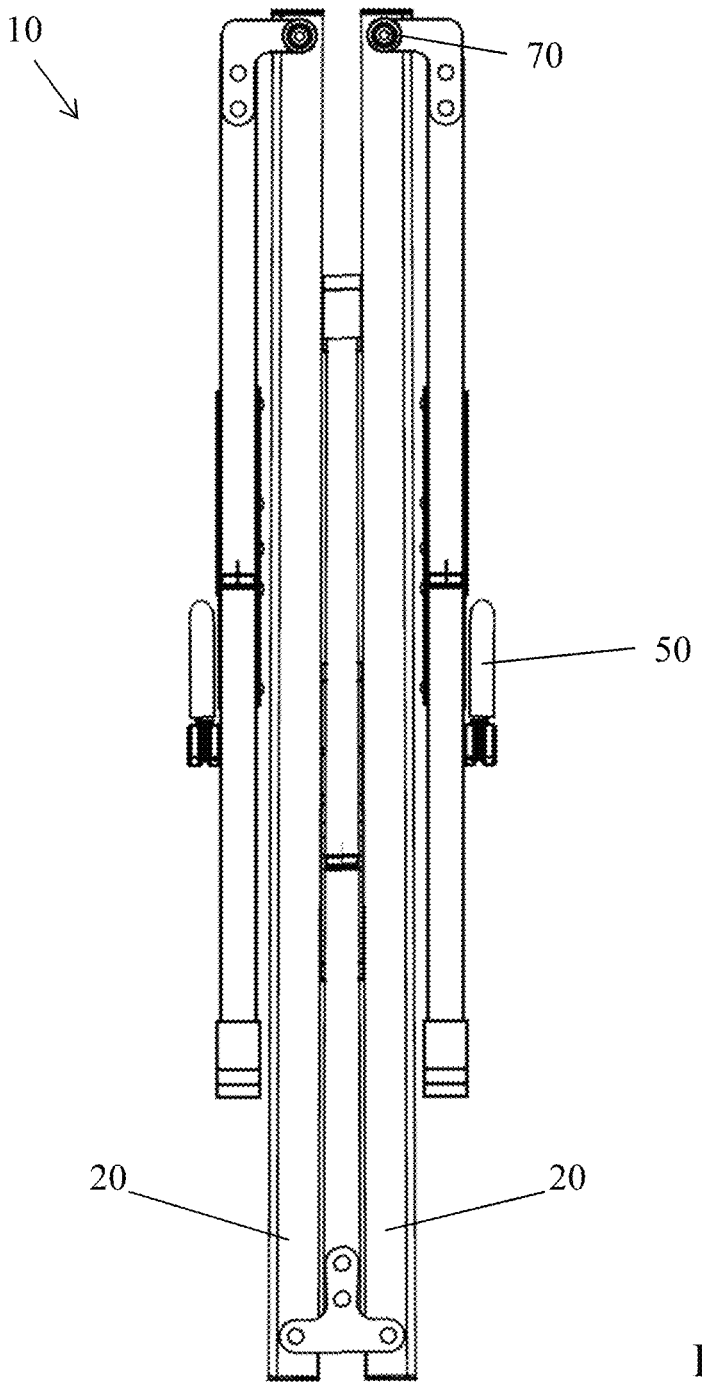
FIG. 7 is a side view of the folded frame of FIG. 6, according to an aspect of the disclosure.

FIG. 7 is a side view of the fully folded frame 10 of FIG. 6. Again, the sheet material 40 is not shown to best illustrate the frame 10. Here, both the cross member 50 on the head end 41 of the folding cot 1 and on the foot end 42 of the folding cot 1 are shown. Both cross member 50 are bent.

Some known folding cots have tethers on the four corners of the sheet material to make the sheet material taut. Such known tethers require a user to loop the tether around the ends of the rail members every time during unfolding of the cot. Equally inconvenient, these known tethers require a user to manually unloop the tether from the ends of the rail member during every folding procedure of the cot.

Figure 8:
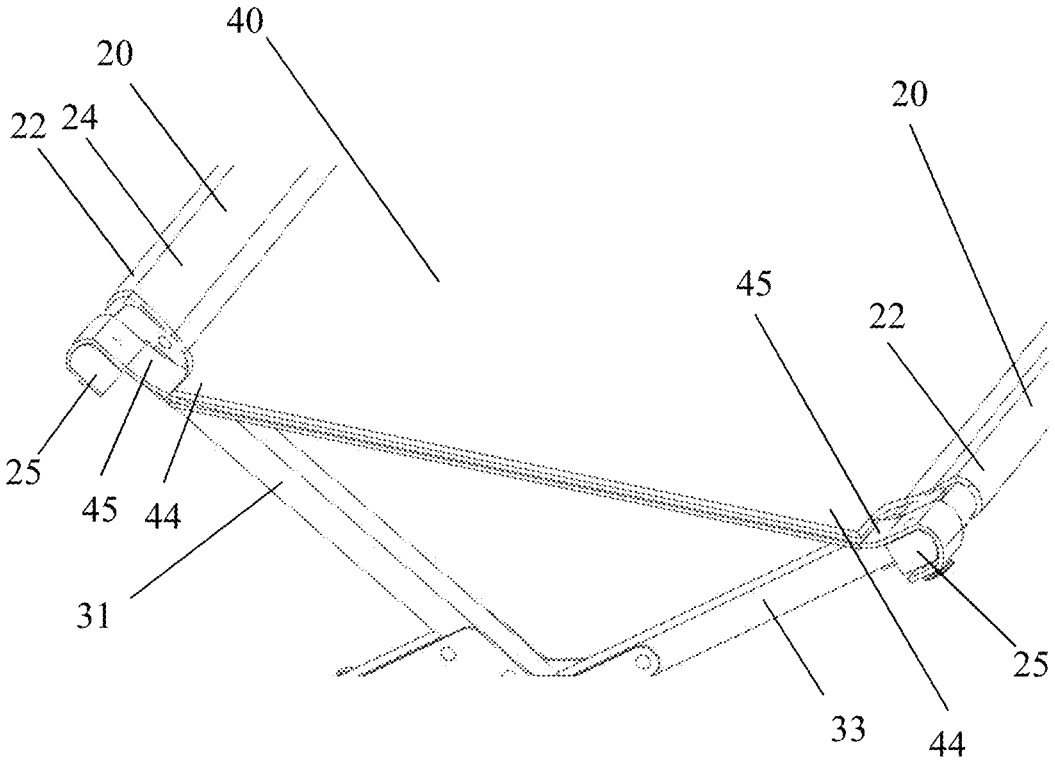
FIG. 8 is a close up view of the head end of the folding cot of FIG. 1, according to an aspect of the disclosure.

One contemplated design of in the current disclosure provides tethers 45 that remain attached to their respective rail members 20 during folding and unfolding of the cot 1. In FIG. 8, contemplated tether 45 can extend from a corner region of the sheet material 40. The tether 45 can be fixedly attached to the rail member 20 such that the tether 45 cannot be readily detached from the rail member 20 without using a tool. In another embodiment, the tether 45 can be fastened to the rail member by a fastener such as a screw.

The same is true in that the one contemplated embodiment of tether 45 cannot be readily detached from the sheet material 40 without using a tool. In another embodiment, the tether 45 is an integral part of the sheet material 40.

Figure 9:
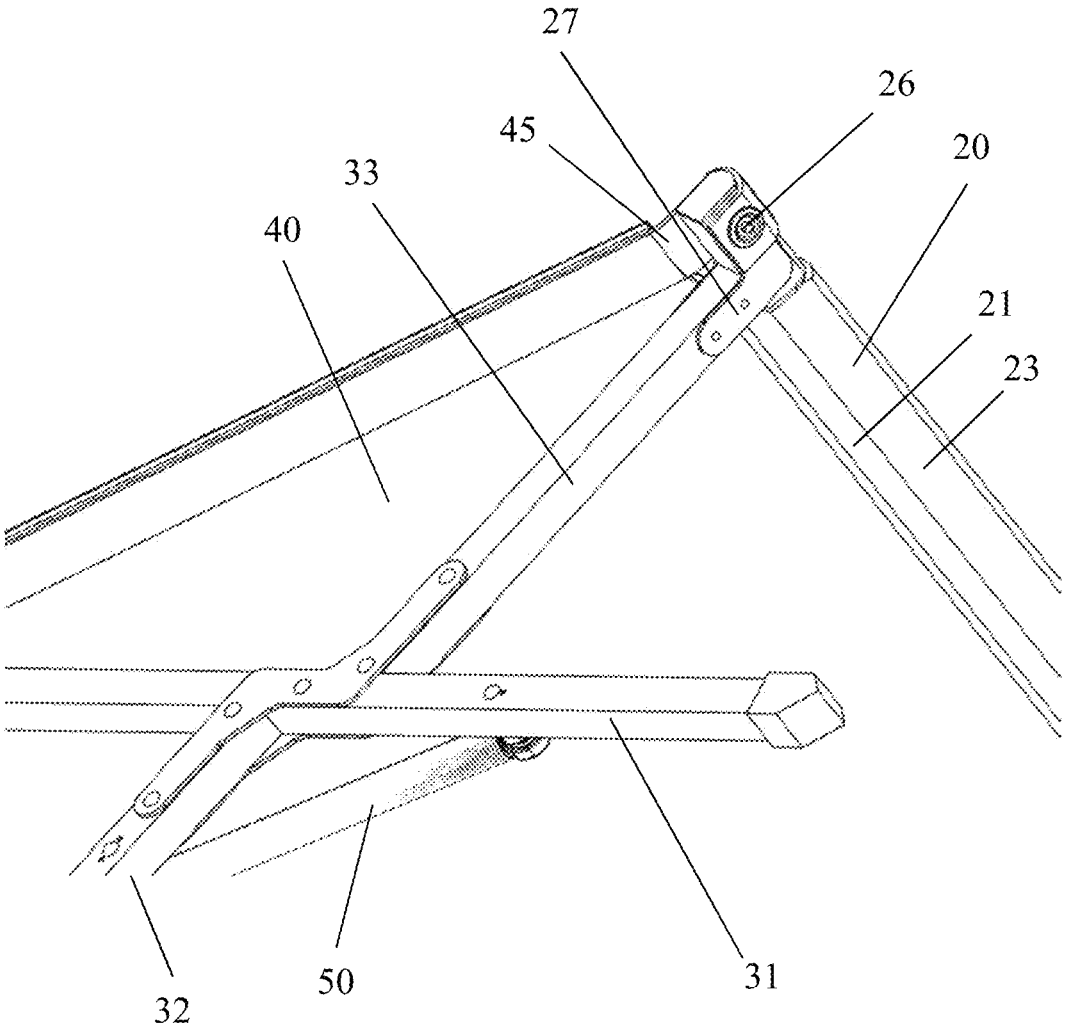
FIG. 9 is a close up bottom view of the head end of the folding cot of FIG. 8, according to an aspect of the disclosure.

In FIG. 9, tether 45 is shown to be fastened to the pivot point 26 which the elbow bracket 27 pivots about. By fastening the tether 45 to the pivot point 26, manufacturing procedure, time, and cost can be drastically reduced. This is because a single fastener 70 can be used to attach multiple parts together in a single procedure step.

Tether 45 can also be fastened to other locations proximate to the pivot point 26. For example, it is contemplated that the tether 45 can be fastened to an underside 21 of the rail member 20 proximate to the pivot point 26. Looking at FIG. 9, this can be a location to the left of the elbow bracket 27, adjacent the pivot point 26 at a same lengthwise location on the rail member 20. More preferably, this can be a location to the right of the elbow bracket 27, at a more proximal lengthwise location on the rail member 20.

Also, it is contemplated that the tether 45 can be fastened to an outer side 23 of the rail member 20 proximate to the pivot point 26. Looking at FIG. 9, this can be a location to the left of the pivot point 26, at a more distal lengthwise location on the rail member 20. Alternatively, this can be a location to the right of the elbow bracket 27, at a more proximal lengthwise location on the rail member 20.

Figure 10:
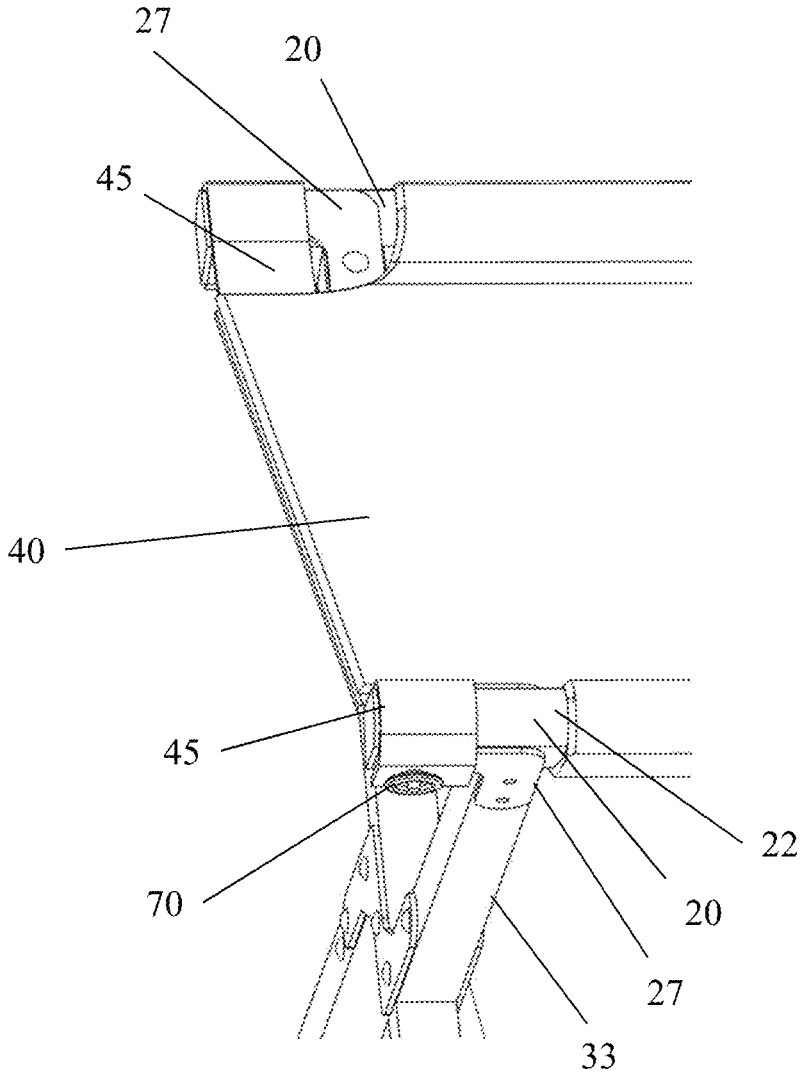
FIG. 10 is a side perspective view of the head end of the folding cot of FIG. 8, according to an aspect of the disclosure.

In other embodiments, it is contemplated that the tether 45 can be fastened to an upper side 22 (see FIGS. 8, 10) of the rail member 20 proximate to the pivot point 26. Looking at FIG. 10, this can be a location at a more distal lengthwise location or more proximal lengthwise location on the rail member 20.

In one specifically contemplated embodiment, the tether 45 cannot extend across the underside 21 of the rail member 20 when the folding cot 1 is either in a folded, unfolded, or both positions.

In another specifically contemplated embodiment, the tether 45 cannot be in direct contact with the underside 21 of the rail member 20 when the folding cot 1 is in a folded, unfolded, or both positions.

In another specifically contemplated embodiment, the tether 45 cannot be directly attached to the upper side 22 of the rail member 20 when the folding cot 1 is in a folded, unfolded, or both positions.

In yet another contemplated embodiment, the tether 45 can extend across the either the upper side 22 or terminal side 25 of the rail member 20 when the folding cot 1 is either in a folded, unfolded, or both positions.

In still another embodiment, the tether 45 can be fastened to the terminal side 25 of the rail member 20 when the folding cot is in a folded, unfolded, or both positions.

Figure 11:
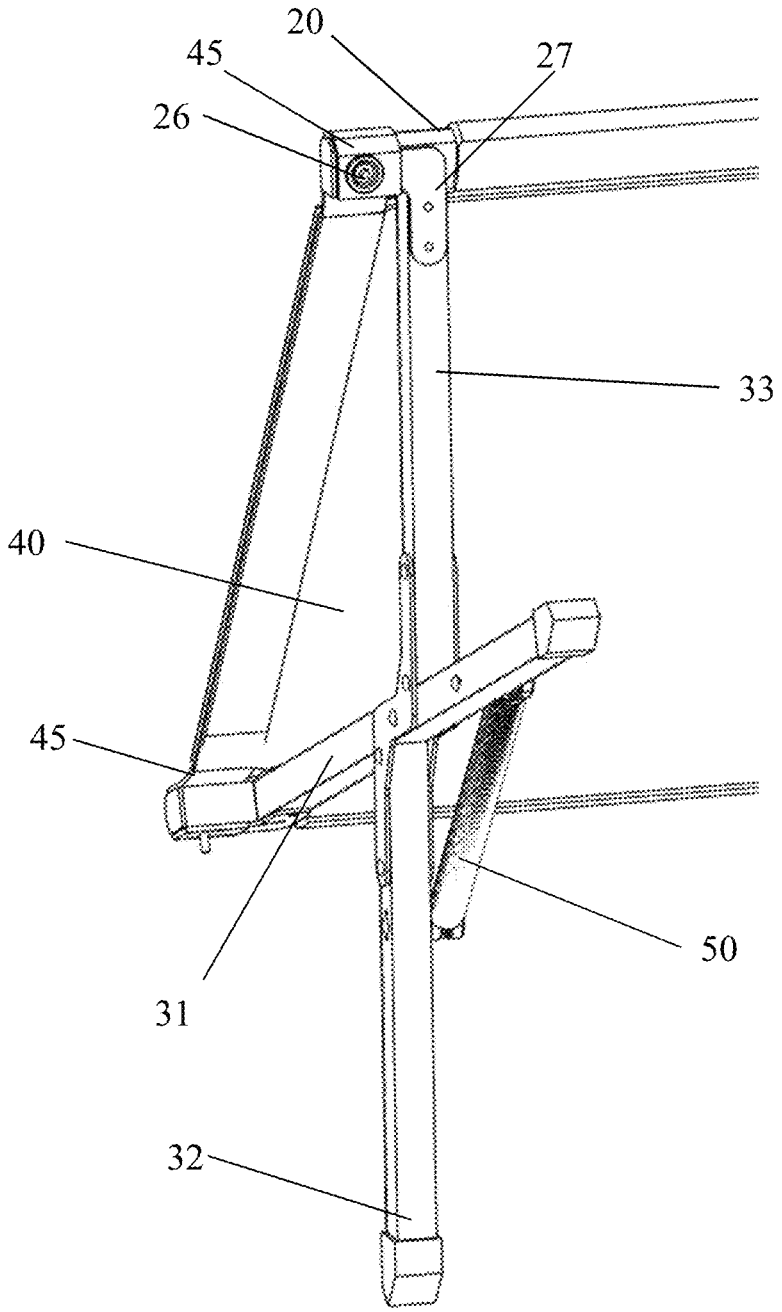
FIG. 11 is another close up bottom view of the head end of the folding cot of FIG. 8, according to an aspect of the disclosure.
Figure 12:
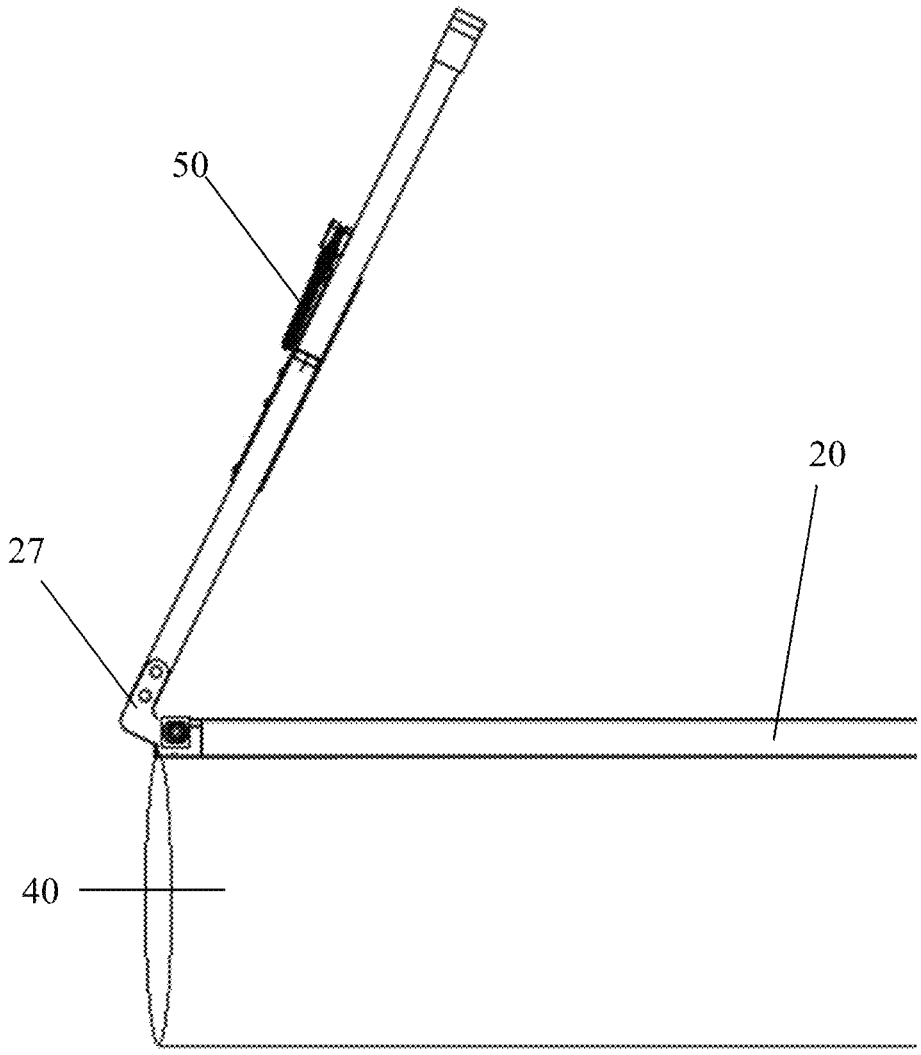
FIG. 12 is side view of the head end of the folding cot of FIG. 1, where the leg assembly of the head end is folded and pivoted halfway onto the rail members, according to an aspect of the disclosure.
Figure 13:
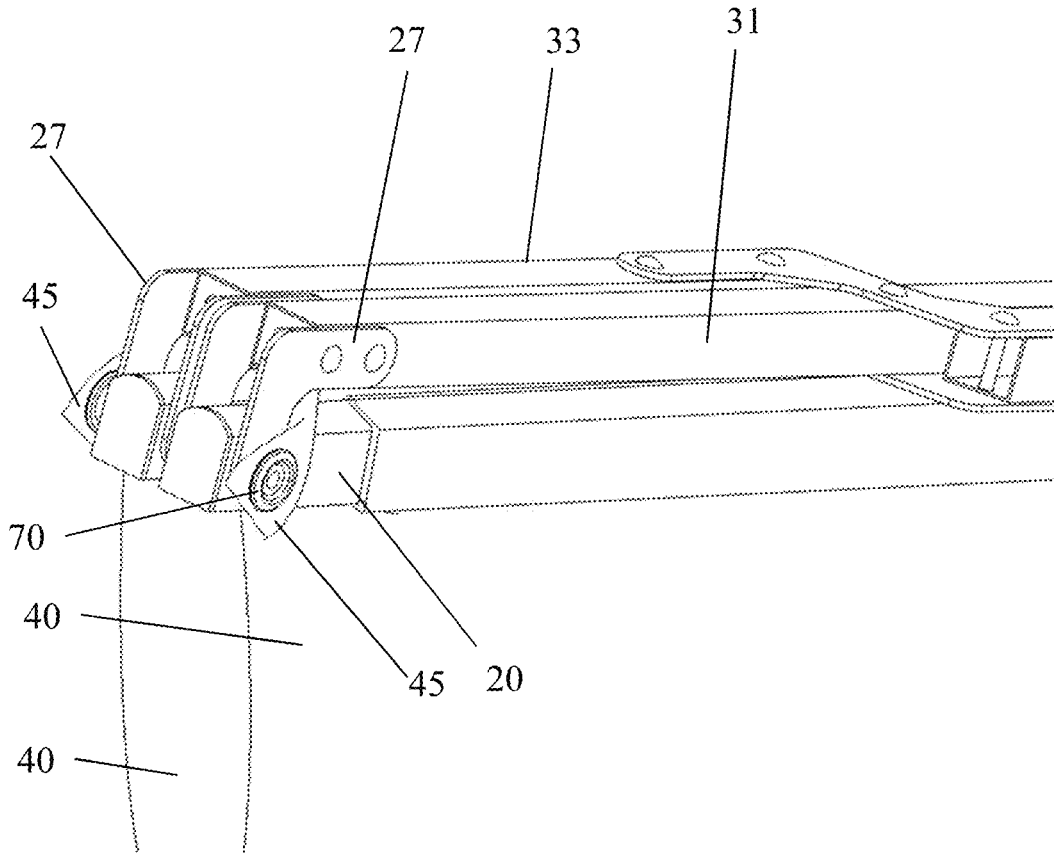
FIG. 13 is close up perspective view of the head end of the folding cot of FIG. 1, where the leg assembly of the head end is folded and fully pivoted onto the rail members showing the tethers, according to an aspect of the disclosure.

FIG. 11 provides a clear view of one embodiment where the tether 45 is attached to the pivot point 26. Here, in a unfolded position, the first leg 31 and the support arm 33 are each individually pivotally attached to its respective rail member 20 via respective elbow bracket 27. Both the first leg 31 and the support arm 33 are positioned closer to the center of the rail member 20 than where the tether 45 is. FIGS. 12 and 13 will illustrate the positions of the tether 45 as the folding cot 1 goes from a unfolded position to a folded position.

In FIG. 12, the first leg 31 swings toward the left of the figure and pivots about the pivot point 26. The first leg 31 is halfway folded onto the rail member 20 and is now disposed above the rail member 20. In this position, the tether 45 remains fastened to the pivot point 26. At the same time, the sheet material 40 is no longer taut as the two parallel rail members 20 move closer to each other. The two parallel members 20 are able to move closer to each other because the leg assembly 30 is folded. Here, cross member 50 is in a bent configuration.

Now referring to FIG. 13, both the first leg 31 and the support arm 33 are fully folded unto their respective rail members 20. The elbow bracket 27 and the tether 45 remain fastened to the pivot point 26 using fastener 70. Because sheet material 40 is in a relaxed state, there can be more give to tether 45, thereby allowing tether 45 to move out of way when elbow bracket 27 forcibly pivots into a fully folded position.

In some embodiments, the tether is made of a stretchable material. In other embodiments, the tether is made of a non-stretchable material.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of a folding cot have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

What is claimed is:

1. A folding cot comprising:

a frame including a first rail member and a second rail member;

a sheet material coupled to the frame and extending between the first and second rail members thereof;

a plurality of foldable leg assemblies each leg assembly being pivotally connected to the first and second rail members, wherein each leg assembly further comprises a first leg pivotally coupled to a second leg;

a single-piece cross member having a first end attached to the first leg and a second end attached to the second leg;

wherein the first leg is pivotally coupled to the first rail member at a first pivot point;

wherein there is no pivoting joint within the single-piece cross member, and the single-piece cross member is self-biased against bending when a force is applied towards the cross member in a direction perpendicular to a longitudinal axis of the cross member; and wherein the cross member is a tension spring.

2. The folding cot as recited in claim 1 further comprising a cylindrical sleeve covering over a substantial length of the cross member.

3. The folding cot as recited in claim 1, wherein the cross member is self-biased into a straight configuration.

4. The folding cot as recited in claim 1, wherein the said folding cot being collapsible between a folded configuration and an unfolded configuration, and wherein the sheet material has a first tether extending from a left corner region of the sheet material and is fastened to the first rail member either at the first pivot point or at a location on one of said pair of rail members approximate the first pivot point.

5. The folding cot as recited in claim 4, wherein in the unfolded configuration, the first tether does not extend across an underside of the first rail member.

6. The folding cot as recited in claim 4, wherein in the unfolded configuration, the first tether and the second tether extend across an upper side of the first rail member.

7. The folding cot as recited in claim 4, wherein in the folded configuration, the first tether remains fastened to the first rail member and is not readily detachable from the first rail member.

8. The folding cot as recited in claim 4, wherein the first tether is fastened to the first pivot point.

9. The folding cot as recited in claim 4, wherein the first tether is not readily detachable from the first rail member and from the sheet material, and the first tether remains attached to the first rail member when the cot changes from the folded configuration to the unfolded configuration.

10. A folding cot, comprising:

a frame including a first rail member and a second rail member;

a sheet material coupled to and extending between the first and second rail members thereof;

the sheet material having a head end and foot end;

a first foldable leg assembly having a first leg and a second leg, where the first leg is pivotally connected to a second leg;

wherein the first leg is pivotally connected to the first rail member by a first fastener at a first pivot point;

said folding cot being collapsible into a folded configuration from an unfolded configuration;

wherein the head end of the sheet material has a first tether extending therefrom;

wherein the head end of the sheet material has a second tether disposed opposite of the first tether, wherein the first tether is fastened to the first rail member either at the first pivot point or directly on the first rail member approximate the first pivot point;

wherein the first tether is not readily detachable from the first rail member;

wherein each of said first and second rail member has an upper side, underside, outer side, interior side, and a terminal side; and wherein the cross member is a tension spring.

11. The folding cot as recited in claim 10, wherein in the unfolded configuration, the first tether does not extend across the bottom side of the first rail member.

12. The folding cot as recited in claim 11, wherein in the unfolded configuration, the first tether extends across the upper side of the first rail member.

13. The folding cot as recited in claim 12 further comprising a first cross member having a first end attached to the first leg and a second end attached to the second leg, wherein the first cross member is adapted to bend from a straight configuration to a curved configuration.

14. The folding cot as recited in claim 13 wherein the cross member is self-biased to remain in the straight configuration.

15. The folding cot as recited in claim 14 further comprising a sleeve enveloping the tension spring.

* * * * *